US005676351A

United States Patent [19]

Speece et al.

[11] Patent Number: 5,676,351

[45] Date of Patent: Oct. 14, 1997

[54] FENCE POST CLIP FOR FASTENING FENCING TO POST

[75] Inventors: Stephen A. Speece, North Jackson; Arthur Miller, Lowellville, both of Ohio

[73] Assignee: Steel City Corporation, Youngstown, Ohio

[21] Appl. No.: 695,021

[22] Filed: Aug. 9, 1996

[51] Int. Cl.[6] ..... E04H 17/04

[52] U.S. Cl. ..... 256/54; 256/47

[58] Field of Search ..... 256/54, 56, 47, 256/DIG. 3

[56] References Cited

U.S. PATENT DOCUMENTS

| | | | |
|---|---|---|---|
| 796,688 | 8/1905 | Witty . | |
| 1,236,150 | 8/1917 | Daniels | 256/54 |
| 1,360,375 | 11/1920 | Dammann | 256/54 |
| 1,519,502 | 12/1924 | Nalle . | |
| 1,925,488 | 9/1933 | Kern . | |
| 3,037,745 | 6/1962 | Zeman . | |
| 4,728,068 | 3/1988 | Rivkin . | |
| 5,039,040 | 8/1991 | Ikjakiren . | |
| 5,255,898 | 10/1993 | Cacicedo . | |

FOREIGN PATENT DOCUMENTS

| | | | |
|---|---|---|---|
| WO 93/20313 | 10/1993 | WIPO | 256/54 |

*Primary Examiner*—Anthony Knight
*Attorney, Agent, or Firm*—Harpman & Harpman

[57] ABSTRACT

A universal fastening clip for securing synthetic resin mesh fencing to apertured fence posts. The fastening clip has a split shank with multiple retaining fingers for engagement into the apertured fence post. Integral retaining disks on each shank with an interconnecting element for interengaging the mesh fencing for securing the fencing to the fence post. The shank extends through smaller fence mesh while the interconnecting element engages alternate large gauge fencing elements.

9 Claims, 3 Drawing Sheets

FENCE POST CLIP FOR FASTENING FENCING TO POST

BACKGROUND OF THE INVENTION

1. Technical Field

This invention relates to fastening devices for securing fencing to fence posts. In the fencing art it is well known that fastening devices must be used to secure fencing to vertical support posts and heretofore a variety of clip and inserting devices have been used.

2. Description of Prior Art

Prior art means and method for fastening fencing to fence posts span the gambit from simple tack configuration and staples that are driven into wood posts to a variety of fencing retaining fasteners emulating large head tacks or nails and custom design clips that engage and hold fencing elements to registering receptacles. Examples of same can be seen in the following U.S. Pat. Nos.; 5,255,898, 5,039,040, 4,728,068, 3,037,745, 1,925,488, 1,519,502, and 796,688.

In U.S. Pat. No. 5,255,898 a medal fastening device is disclosed having a nail-like member with ridges or barbs with a mesh engagement head. U.S. Pat. No. 5,039,040 is directed towards a snap fastener wherein resilient tangs extend from both sides of an arm so as to snap and define a holding relation through an aperture securing the fastener therein.

A removable anchor for securing perforated panel hangers is illustrated in U.S. Pat. No. 4,728,068 having engagement barbs with attached pull tabs extending therefrom so that the respective tabs can be collapsed and removal of anchors achieved.

U.S. Pat. No. 3,037,745 discloses a post assembly having a plurality of intersecting longitudinally spaced bars for receiving wire engagement plugs. The plugs are tapered with a wire insert slot.

In U.S. Pat. No. 1,925,488 a metal fastener is disclosed having a generally U-shaped configuration with oppositely disposed engagement figures that interlock with a slotted opening in a hollow support post.

A wire fastening device is set forth in U.S. Pat. No. 1,519,502 wherein a split fastener is engaged over a wire and inserted into a registration sleeve insert in the post. The sleeve wedgeably spreads the fastener apart securing same within the sleeve.

Finally, in U.S. Pat. No. 796,688 a concrete fence post and fencing holder having a contoured anchor block with a matching insertable fastening clip with multiple registering teeth formed thereon.

SUMMARY OF THE INVENTION

A fastening clip for securing synthetic resin mesh fencing to a typical metal fence post. The fastening clip is adapted to hold different plastic mesh fencing configurations by engaging through and over smaller mesh configurations by a pair of mounting disks engaging and holding portions of several mesh junction points against the fence post. A split shank and interconnecting retaining element on the fastening clip is adaptable to slip onto a single interconnecting web member in large mesh fencing typically used as temporary warning fences around excavation and construction sites.

DESCRIPTION OF THE PREFERRED EMBODIMENT

Figure 1:
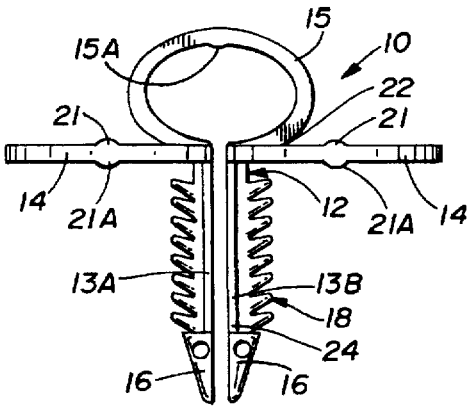
FIG. 1 is an enlarged front elevational view of the fastening clip of the invention.
Figure 2:
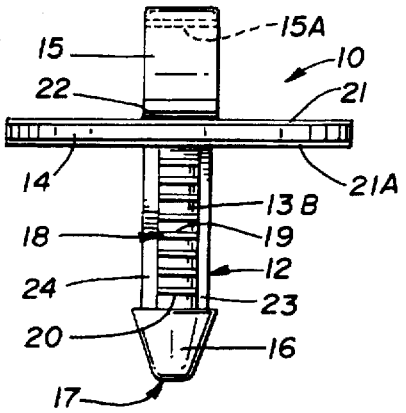
FIG. 2 is an enlarged side elevational view of the fastening clip of the invention.
Figure 3:
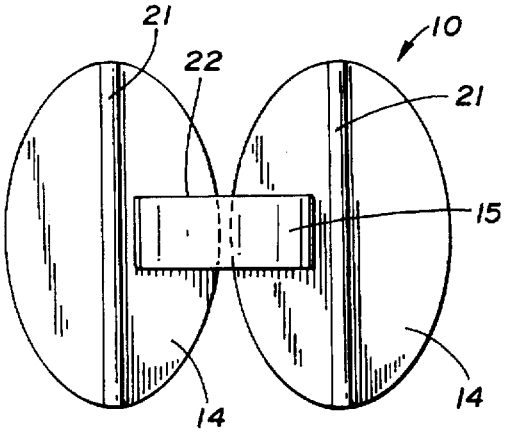
FIG. 3 is a top plan view of the fastening clip of the invention.
Figure 4:
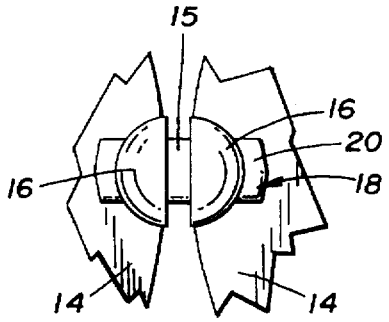
FIG. 4 is an enlarged bottom plan view of the fastening clip of the invention with portions broken away.
Figure 5:
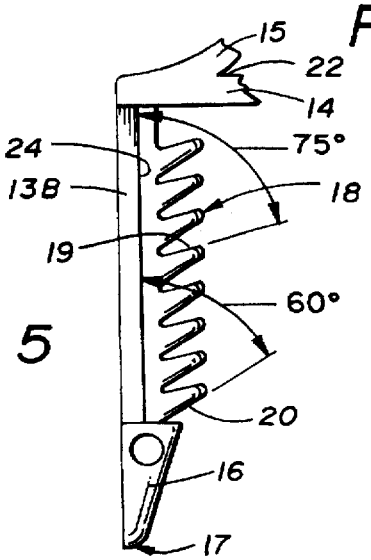
FIG. 5 is an enlarged partial side elevational view of the split shank portion illustrating angular inclination of multiple retaining barbs thereon.

Referring now to FIGS. 1–3, and 6–7 of the drawings, a fastening clip 10 can be seen for securing mesh-like fencing 11 to a metal fence post 12. The fastening clip 10 of the invention includes a split post engagement shank 13 with respective shank portions 13A and 13B each having a generally flat, ovaloid retaining disk 14 extending transversely therefrom. The shank portions 13A and 13B are interconnected by an engagement loop band 15, best seen in FIG. 1 of the drawings. Each of the shank portions 13A and 13B has an enlarged end tip half 16 that together form a tapered insert point at 17. A plurality of angularly inclined resilient retaining barbs 18 extend from each of said shank portions in longitudinal vertically spaced relation to one another between the respective end tip half 16 and retaining disks 14. Each of the retaining barbs 18 have an upper angular surface 19 and lower angular surface 20 with different effective angular inclinations from the vertical axis of the respective shank portions of 70 degrees for the upper angular surface 19 and 65 degrees for the lower angular surface 20 defining a taper therebetween as best seen in FIG. 5 of the drawings.

Referring back to FIGS. 1–3 of the drawings, the retaining disks 14 extend respectively from the upper portion of each shank portion 13A and 13B outwardly therefrom in a horizontal spaced relation from one another. Each retaining disks 14 has a mold ejector rib 21 extending centrally thereacross at right angles to said longitudinal axis of the loop band 15. A corresponding aligned ejector rib 21A is positioned on an underside of each retaining disk 14.

The loop band 15 extends from and between the intersections of said respective retaining disks 14 and shank portions 13A and B at 22. The loop band 15 has a transverse mold ejection rib 15A at its inner vertical apex.

Referring back to FIG. 2 of the drawings, the retaining barbs 18 on each shank portion are recessed transversely thereon with oppositely disposed elongated guide areas 23 and 24 that extend from the respective tip half 16 to the respective disks 14 as hereinbefore described.

Figure 6:
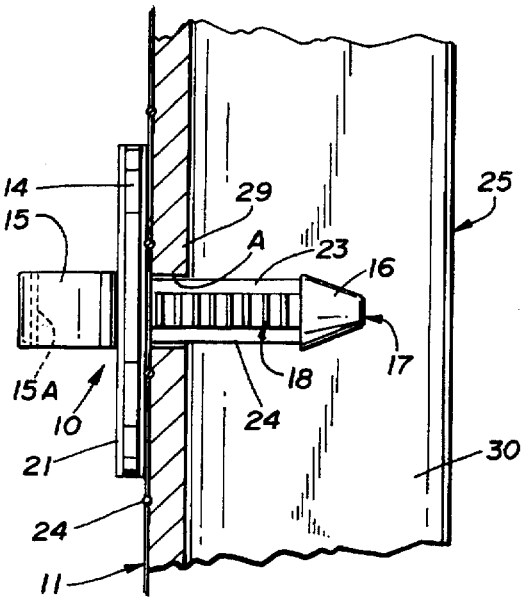
FIG. 6 is a side elevational view of a portion of the fastening clip in a fence post retaining mesh fencing therebetween.
Figure 7:
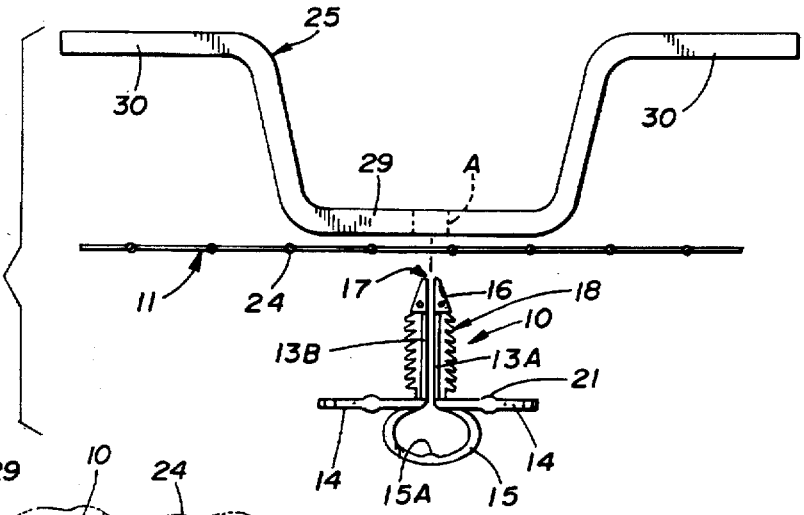
FIG. 7 is an enlarged exploded top plan view of the fence post and clip prior to assembly.
Figure 8:
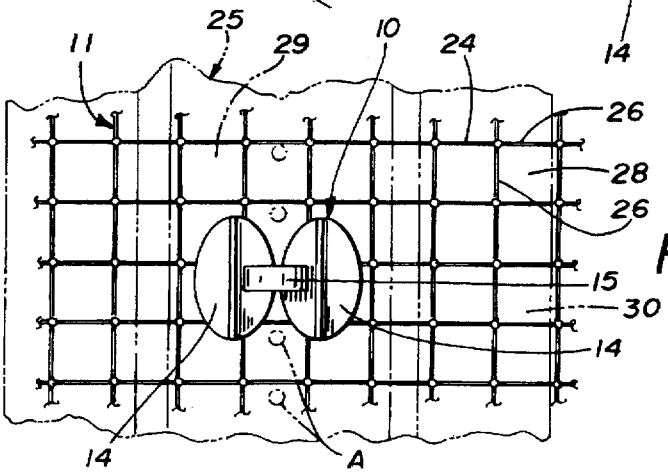
FIG. 8 is a graphic illustration indicating the engagement point of the fence post fastener on a small mesh fencing mounted on a metal fence post shown in broken lines.

Referring now to FIGS. 6–10 of the drawings, the fastening clip 10 of the invention can be seen in use securing a synthetic resin fencing mesh 24 to a metal post 25. The synthetic resin fence mesh 24 defines interengaging cross elements 26 to form interconnected openings at 28. The fence post 25 is of a typical stamped metal configuration, well known within the art, having a recessed center mounted portion 29 with offset parallel edge portions 30. The center mounting portion 29 typically has a plurality of vertically spaced apertures A therein which in this application are to receive the fastening clip 10 of the invention. Referring to FIGS. 6–8 of the drawings, the fastening clip 10 is shown in use with the mesh 24 being positioned against the center mounting portion 29 of the post 25 and the fastening clip 10 shown aligned for insertion in one of the respective apertures A on the post 25.

Upon fastener insertion into the post 25, the split shank portions 13A and 13B compress together and their associated retaining barbs 18 selectively engage and adjustably hold the fastening clip 10 within the aperture A. The fence mesh 24 is thus held against the post 25 shown in broken lines by the disks 14 by their overlapping respective portions thereof as illustrated in solid lines in FIG. 8 of the drawings.

Figure 9:
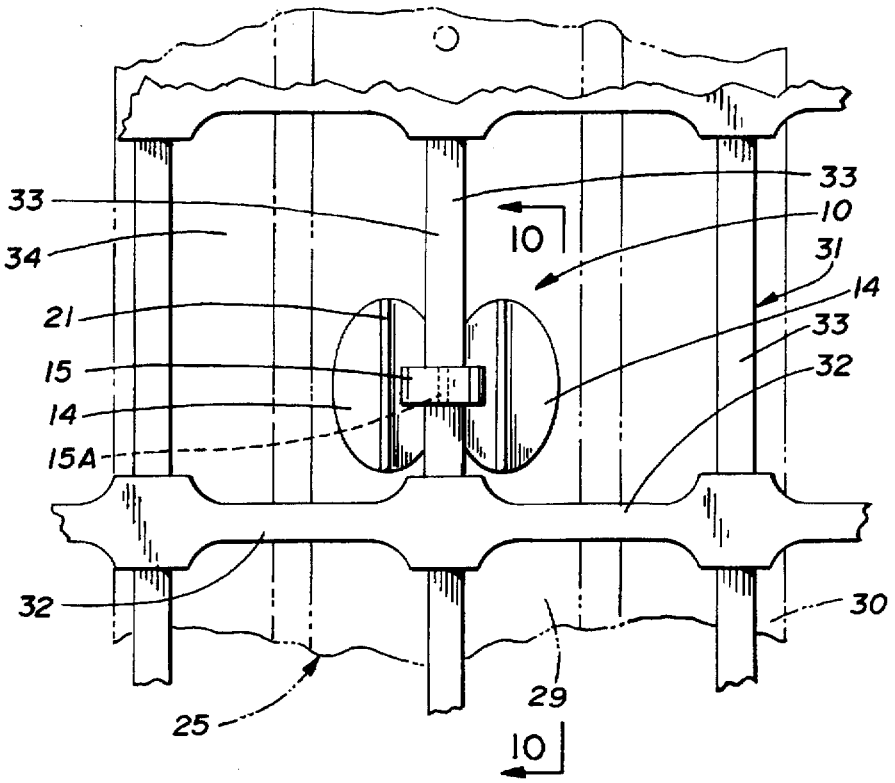
FIG. 9 is an enlarged graphic illustration indicating the engagement of a fence post fastener on a large mesh fence configuration mounted on metal post shown in broken lines.
Figure 10:
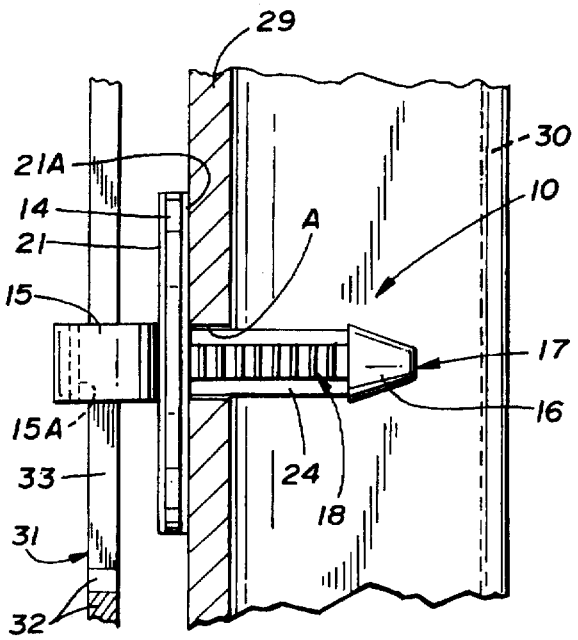
FIG. 10 is a side elevational view on lines 10—10 of FIG. 9.

Referring now to FIGS. 9 and 10 of the drawings, an alternate synthetic resin fencing 31 can be seen having a large mesh configuration wherein a plurality of vertically spaced horizontally extending parallel elements 32 having interconnected vertically aligned cross elements 33 that combine to define large mesh openings at 34 therebetween.

In use, the cross elements 33 of the fencing 31 are inserted into the fastening clip 10 between the shank portions 13A and 13B and retained within the engagement loop band 15. The fastening clips 10 are then inserted into the respective apertures A of the fence post 25, shown in broken lines in FIG. 9 of the drawings, as hereinbefore described securely retaining the fencing 31 to the post.

It will be apparent from the above description that the fastening clip 10 of the invention is capable of engaging and holding a variety of mesh fence configurations of varying sizes and designs to a typical stamped metal fence post 25 or alternate post configurations, not shown, having similar apertures therein.

The fastening clip 10 of the invention is of a one-piece molded synthetic resin material for durability and ease of manufacturing. The ejection ribs 21 and 21A on the disks 14 and ejection rib 15A on the loop band 15 are provided for mold removal purposes only and are well known and understood by those skilled in the molding art.

It will thus be seen that a new and novel universal fastening clip has been illustrated and described and that various changes and modifications may be made therein without departing from the spirit of the invention.

Therefore we claim:

1. A fastening apparatus for securing synthetic resin mesh fencing to a fence post or the like, said mesh fencing made of interconnected cross elements defining openings therebetween, said fastening apparatus comprising, a split shank, a retaining loop interconnecting said shank portions, oppositely disposed retaining disks extending from said respective shank portions and a plurality of vertically spaced retaining barbs extending from said shank portions for securing said split shanks within an opening in said fence post.

2. The fastening apparatus of claim 1 wherein said retaining disks are in spaced horizontal relation to one another and extend beyond said retaining loop in both their transverse and horizontal plane.

3. The fastening apparatus of claim 1 wherein said retaining loop extends between the shank portions adjacent the respective retaining elements.

4. The fastening apparatus of claim 1 wherein said retaining disks are generally flat, and ovaloid in appearance.

5. The fastening apparatus of claim 1 wherein said retaining barbs are angularly disposed from said shank portions and each of said barbs are cross-sectionally tapered outwardly from their respective shank portions.

6. A fastening apparatus for fastening synthetic resin mesh fencing to an apertured metal fence post, said synthetic resin mesh fencing made of interengaging elements defining openings therebetween said fastening apparatus comprising; a pair of independent retaining disks with a interconnected loop band therebetween; said retaining disks extending on a horizontal plane beyond said loop band, a split shank extending from said retaining disks adjacent said intersection of said loop band with said split shank portions, a plurality of retaining barbs extending from each of said shank portions in oppositely disposed relation, said split shank and retaining disks defining an opening therebetween.

7. The fastening apparatus of claim 6 wherein said retaining barbs extending from said respective shank portions have an angular inclined upper surface and an angular inclined lower surface.

8. The fastening apparatus of claim 6 wherein said retaining disks are generally flat, and ovaloid in appearance.

9. The fastening apparatus of claim 6 wherein said retaining disks have a rib extending centrally thereacross at right angles to said longitudinal axis of said loop band.

* * * * *